US006443242B1

(12) United States Patent
Newman et al.

(10) Patent No.: US 6,443,242 B1
(45) Date of Patent: Sep. 3, 2002

(54) METHOD FOR WELLBORE OPERATIONS USING CALCULATED WELLBORE PARAMETERS IN REAL TIME

(75) Inventors: Kenneth Ray Newman, Willis; Albert Rice McSpadden, Conroe, both of TX (US)

(73) Assignee: CTES, L.C., Conroe, TX (US)

( * ) Notice: Subject to any disclaimer, the term of this patent is extended or adjusted under 35 U.S.C. 154(b) by 104 days.

(21) Appl. No.: 09/675,680

(22) Filed: Sep. 29, 2000

(51) Int. Cl.[7] ..... E21B 7/00

(52) U.S. Cl. ..... 175/57; 166/381; 175/40; 702/9

(58) Field of Search ..... 175/27, 24, 40, 175/57; 702/9; 166/381, 385

(56) References Cited

U.S. PATENT DOCUMENTS

| | | | | |
|---|---|---|---|---|
| 4,804,051 A | * | 2/1989 | Ho | 175/26 |
| 5,044,198 A | | 9/1991 | Ho | 73/151 |
| 5,184,682 A | | 2/1993 | Delacour et al. | 166/385 |
| 5,411,085 A | | 5/1995 | Moore et al. | 166/242 |
| 5,439,064 A | * | 8/1995 | Patton | 175/24 |
| 5,503,370 A | | 4/1996 | Newman et al. | 254/134.3 FT |
| 5,660,239 A | * | 8/1997 | Mueller | 175/57 |
| 5,806,612 A | | 9/1998 | Vorhoff et al. | 175/40 |
| 5,812,068 A | * | 9/1998 | Wisler et al. | 175/40 |
| 5,813,480 A | | 9/1998 | Zaleski, Jr. et al. | 175/40 |
| 5,826,654 A | | 10/1998 | Adnan et al. | 166/250.01 |
| 5,842,149 A | * | 11/1998 | Harrell et al. | 702/9 |
| 6,026,912 A | | 2/2000 | King et al. | 175/27 |
| 6,105,690 A | | 8/2000 | Biglin, Jr. et al. | 175/48 |
| 6,109,367 A | | 8/2000 | Bischel et al. | 175/24 |
| 6,109,368 A | * | 8/2000 | Goldman et al. | 175/39 |
| 6,206,108 B1 | * | 3/2001 | MacDonald et al. | 175/24 |

OTHER PUBLICATIONS

"Advances Culminate In 'Smart'Systems," Turner, The American Oil & Gas reporter, pp. 65,66,68,69; Apr. 1999.
General Formulation of Drillstring Under Large Deformations and Its Use in BHA Analysis, Ho, SPE 15562, 1986.
Prediction of Drilling Trajectory In Directional Wells Via A New Rock–Bit Interaction Model, Ho, SPE 16658, 1987.
Field Comparison of 2–D and 3–D Methods for the Borehole Friction Evaluation in Directional Wells, Maidla et al, SPE 16663, 1987.
An Improved Modeling Program For Computing The Torque and Drag in Directional and Deep Wells, Ho, SPE 18047, 1988.

* cited by examiner

*Primary Examiner*—Hoang Dang
(74) *Attorney, Agent, or Firm*—Guy McClung

(57) ABSTRACT

A method for taking into account the effects of complex conveyance method model technique results in real time in a wellbore operation, the method including, in certain aspects, calculating with a conveyance method model technique a series of data points based on wellbore data (actual and/or predicted), modeling the relationship between the series of data points and the wellbore data using a simple mathematical model technique to develop a model for predicting a wellbore operations parameter, and using the model to predict a wellbore operations parameter; and, in one aspect, a procedure for drilling a wellbore in the earth using such a method to predict, among other things, weight on bit, torque on bit and stretch of a conveyance system (coiled tubing, wireline, drill pipe string) used to move the bit in a wellbore.

30 Claims, 1 Drawing Sheet

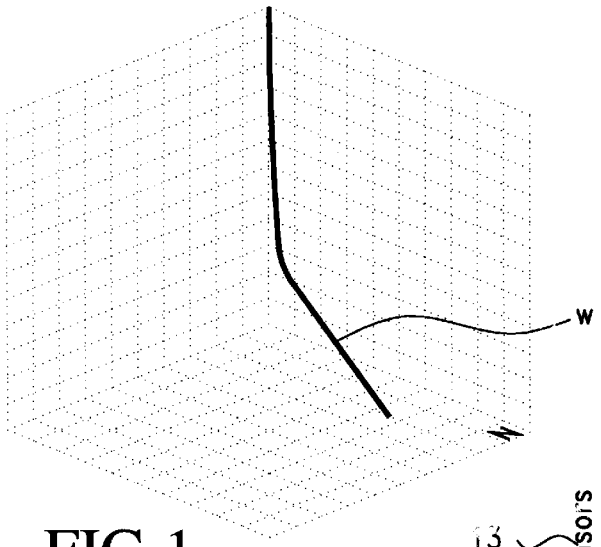
FIG.1
FIG4
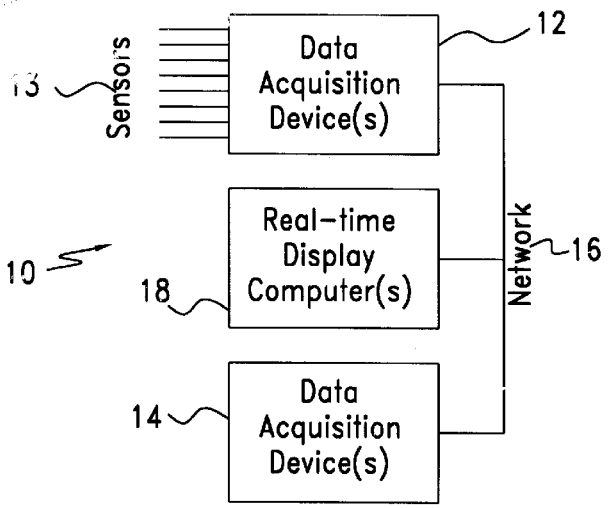
FIG.2
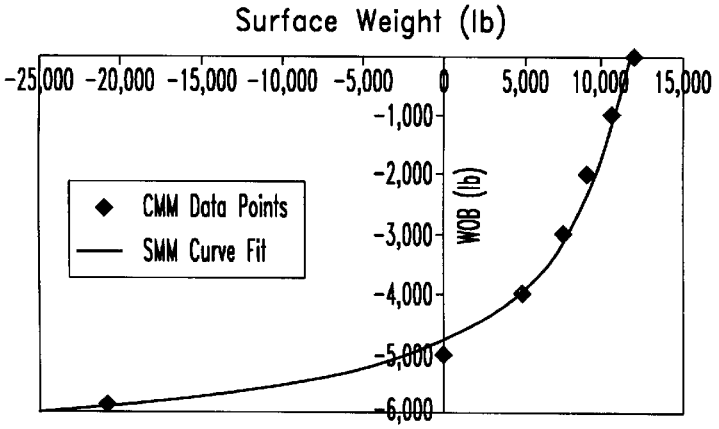
FIG.3
| Stretch (ft) | | Flow Rate(gpm) | | | |
|---|---|---|---|---|---|
| | | 0 | 50 | 100 | 150 |
| Depth (ft) | 0 | 0 | 0 | 0 | 0 |
| | 2500 | 1.1 | 1 | 0.9 | 0.6 |
| | 5000 | 3.8 | 3.6 | 3.1 | 2.4 |
| | 7500 | 7.2 | 6.8 | 5.8 | 4.4 |
| | 10000 | 11.4 | 10.7 | 9.1 | 6.7 |

METHOD FOR WELLBORE OPERATIONS USING CALCULATED WELLBORE PARAMETERS IN REAL TIME

BACKGROUND OF THE INVENTION

1. Field of the Invention

2. Description of Related Art

Three basic methods for moving items used in subterranean wells, known as conveyance methods (CM) are:

Jointed Pipe (JP)—sections of pipe are screwed together at "joints" to form a "string" of pipe. JP includes drill pipe, production tubing and casing. Drill pipe and drill collars are used to form drill strings.

Coiled Tubing (CT)—continuous tubing or pipe which is coiled onto a reel at the surface, and spooled on and off the reel when being run in and out of a well.

Wireline (WL)—cable. There are several types of WL, including electric cable, braided cable, and "slick-line".

Computer based models have been developed to calculate many quantities such as the forces, stresses, torques, stretch, etc. associated with these conveyance methods as the pipe, tubing or wireline are run into and out of subterranean wells. U.S. Pat. No. 5,044,198 gives a detailed description of one such model used for drilling. The known prior art, Orpheus software (commercially available from the owner of this invention) models all of these CM. Mathematical models or CMM's (conveyance method models) refer to computer models for the various conveyance methods.

These known CMM's take many parameters into consideration when performing calculations. The parameters may vary between the various CM. For example, JP and CT are pipes, so they may have internal pressure and fluid flow. WL has no internal flow path and thus does not have internal pressure and fluid flow. The following is a list of some of the parameters the CMM's take into consideration:

Well properties—hole geometry, temperature and diameter versus the hole depth

Friction—dynamic and static friction coefficients throughout the well

Pressures—pressures inside and outside along the length of the well

Fluid properties—viscosity, density and flow rates of the fluids inside and outside of systems used in the CM Material properties—strength and elastic modulus of the material the systems used in the CM are made of Dimensions of CM systems—inside and outside diameters along the length Applied torques and forces—torque and/or force applied at the downhole end of the CM system, and/or applied at the surface Tool properties—length, outside diameter, stiffness, internal diameter, flow restrictions in the tools being conveyed by the CM system, if any Speeds—axial speed and rate of rotation (RPM).

These known CMM's are then used to determine many things such as:

When the CM system is approaching some limit at which it will break or buckle;

How much the CM system will stretch or shrink due to axial forces, helical buckling, temperature and pressure. This change in length is often needed to accurately calculate the depth of the end of the CM system or the location of the tools it is conveying;

How much force can the CM system apply at the downhole end of the tools, either in tension (as in pulling on a plug) or in compression (as in applying weight on bit (WOB)) while drilling;

How much torque is being applied at the downhole end when a certain amount of torque is applied at surface;

How much twist is in the CM system between the surface and the downhole end;

The torsional and axial dynamic frequencies for stick-slip type movements; and

The point at which the CM system is stuck in a well.

It is often desirable to run these CMM models in "real-time". Measured parameters such as the force at surface (often called "hook load" for JP drilling or "weight" for CT and WL applications) and other parameters measured in real-time are input to the CMM, and it calculates the desired values such as a depth correction, WOB, etc. also in real-time. These calculated values are then displayed to those operating the system along with the measured parameters. Usually the display of updated values occur in less than 1 or 2 seconds, to be considered real-time. If dynamic effects are being considered, the real-time calculation must be even faster.

However, the CMM's often require complicated calculations, e.g. numerically solving differential equations repeatedly. Due to the length and complexity of the calculations, the computer may not be able to perform these CMM calculations fast enough to perform real-time updates.

To avoid this problem, highly simplified CMM's have been developed, such as the one in U.S. Pat. No. 6,026,912. Simplified CMM's such as this can be run in real-time, but, are typically accurate for only certain specific cases such as vertical well drilling.

SUMMARY OF THE PRESENT INVENTION

The present invention provides a method for complex CMM calculations to be made available in real-time. According to one aspect of the present invention a CMM includes a computer program that calculates desired output parameters for a range of input parameters ahead of time (e.g. several seconds or minutes ahead of real time, or before the operation begins) based upon the best data available at that time. If the CMM is being run only a short time (seconds or minutes ahead of time), actual current measured data is used. If the CMM is being run before the operation, the data will be estimated or predicted. The relationship between the input and output parameters is then modeled using a relatively simple mathematical model technique such as a curve-fit or data table technique. This simple mathematical model (SMM) technique includes a computer program that is then used in an appropriate computer to determine output parameters in real-time based upon the real-time input parameters.

Curve-fit techniques are known to those skilled in mathematics. There are many types of curve-fits. Given a series of n data points, $(x_j, y_j)$, calculated by a CMM, where x is an input parameter and y is a calculated parameter, the equation of a line or curve is developed which passes through or close to these points. One common curve-fit is linear, taking the form of:

$$y=A+Bx$$

Where A and B are the curve fit constants. This curve-fit forms a linear SMM which calculates the output parameter y for a given input parameter x. It is much easier to calculate than the complex equations in a CMM.

A parabolic (second order polynomial) curve fit would take the form of:

$$y=A+Bx+Cx^2$$

In this case A, B and C are the curve fit constants.

A hyperbolic curve-fit may be written in the form:

$$y=A+B/(x-C)$$

There are many other types of curve-fits known to those skilled in mathematics including logarithmic, exponential, moving average, etc. Curve-fit techniques are known which allow multiple input parameters to be considered. Any suitable type of curve-fit may be used to create the SMM. The curve-fit constants may or may not have any physical significance ("physical significance" means a constant is related to an actual physical parameter, e.g., but not limited to the buoyant weight of the WL in pounds per foot or density of drilling fluid in pounds per gallon).

With any curve-fit technique, there may be some error. In such a case an SMM will not produce exactly the same calculated result as a CMM. The type of curve-fit used in any specific application is chosen carefully to minimize this error. The curve-fit may, in certain aspects, be chosen at the time the SMM software is developed based upon an understanding of the usual shape of the curve, and thus the type of curve-fit which will most likely work well. Alternatively, multiple curve-fits are developed. For each curve-fit an error is calculated based upon the input data points. The curve-fit with the smallest error is then used for the SMM. Alternatively, multiple curve-fits are made available, and the operator chooses the curve-fit to be used in the SMM.

Alternatively, the n data points calculated by a CMM are placed in a data table available to the real-time software. The real-time software uses the data table and interpolates or extrapolates to obtain a desired value. In this case, the SMM is simply the equations used to interpolate or extrapolate. Interpolation and extrapolation are known to those skilled in mathematics.

It may be that multiple SMM's are needed depending on some of the input parameters. For example, when running WL in and out of a deviated well it may be desirable to know the depth of the tools corrected for the change in length of the WL. In such a case one SMM may be used when the WL is being run into the hole (RIH), and a different SMM may be used when the WL is being pulled out of the hole (POOH). The real time software would first determine if the WL is being RIH or POOH, and would then use the appropriate SMM to calculate the depth correction.

Multiple SMM's may be needed for different parameters. For example, in a drilling system a CMM may calculate both the torque on bits (TOB) and the WOB. However, one SMM may be used to calculate the real-time TOB, given the real-time surface torque, and another SMM may be used to calculate real-time WOB given the real-time hook load.

The SMM's usually may not take all of the parameters into consideration. Instead, a CMM is run when necessary to update the SMM's. For the above WL examples, the CMM takes the density of the fluid in the well into consideration because it affects the buoyancy of the CM system and tools. The SMM technique, in one aspect, has well fluid density as one of its input parameters, but this may make the SMM too complicated (to develop and/or to run in real-time. Multiple SMM's are then developed for multiple fluid densities, and the real-time system then chooses the appropriate SMM based on current mud density. However, since the fluid density in the well does not change very rapidly, the CMM may be run from time to time to update the SMM's for the most recent fluid density.

The basic steps employed in certain embodiments of a method according to the present invention are as follows:

1. A CMM is run for a plurality of points covering the expected range of the input parameters, and the output parameters are calculated.
2. SMM's are developed which relate the calculated output parameters to the input parameters. These may be in the form of curve fits—or data tables.
3. The real-time system obtains the real-time input parameters, and then uses the SMM's to calculate the output parameters. Because the SMM's are relatively simple to
4. Step 3 is repeated as fast as necessary for the application, providing a continuous real time display.
5. When a parameter (e.g. depth while drilling) not considered in the SMM's changes significantly, or on a regular time interval, steps 1 and 2 are performed again, and the SMM's are updated. This is performed in a background mode or on a different computer, so that the running of the CMM does not interfere with the real-time updating.

A real time system, according to the present invention, includes, in certain aspects, appropriate data acquisition devices (e.g. sensors), computer(s) with appropriate programming, real-time modeling programs, and real-time displays.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

- New, useful, unique, efficient, nonobvious systems and methods for using complex CMM calculations in real-time for wellbore operations;
- Such systems and methods which employ a relatively simple SMM technique (e.g. curve-fit technique or data table techniques) to determine output parameters in real-time;
- Such systems and methods that use multiple SMM's;
- Such systems and methods in which a CMM is used periodically to update an SMM; and
- Such systems that include data acquisition devices, computer(s) with suitable programming, and/or with real-time displays.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and 'suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 1 is a schematic view of a well profile.

FIG. 2 presents a graph with specific example of CMM data points and an SMM curve-fit.

FIG. 3 is a table of data points for an application of the present invention.

FIG. 4 is a schematic view of a system according to the present invention.

DESCRIPTION OF EMBODIMENTS PREFERRED AT THE TIME OF FILING FOR THIS PATENT

In one embodiment, CT (coiled tubing) is being used to drill a wellbore W with a well profile as shown in FIG. 1. The three lines are the projections of the bore W on the X, Y, and Z planes. A motor at the end of the CT is turning a bit to produce the wellbore. However, it is within the scope of this invention to drill the bore with any known drilling system. A method according to the present invention is used to calculate the WOB in real-time as follows:

1. A CMM (e.g. the CTES Orpheus model with a suitable computer) is used to calculate the WOB versus surface weight (SW) at a specific depth of 8900 ft in the well. The 7 points calculated are as black dots shown in the graph of FIG. 2. Negative numbers imply compression and positive numbers imply tension.
2. A curve fit (SMM) for these 7 points is developed with a computer (using a hyperbolic curve-fit) in the following form:
   WOB=A+B/(SW−C). The curve-fit fits well when A=−6757.2, B=$-33.56\times10^6$, and C=16,985. The resulting curve is shown on FIG. 2. One program used to obtain this curve is commercially available Microsoft Excel)
3. When drilling at depths around 8900 ft, the WOB is calculated in real-time by using the measured SW and calculating WOB with this SMM.
4. As the depth increases to 8910 ft, steps 1 and 2 are repeated, either in a background mode or on another computer. The values of A, B, and C, are changed to: A=−6758.4, B=−34.42, C=17,000. Note that these values are very similar to the values at 8900 ft, so there is no significant change in the real-time displayed WOB when the SMM is updated.

In another embodiment WL is used to run a production logging tool in a well. The measured depth of the logging tool is measured by measuring how much cable enters the well at surface. This measured depth is corrected for the cable stretch due to forces and temperature variations, to obtain an accurate depth. An additional parameter is the well's production flow rate (in barrels per minute) which changes the tension profile of the WL and hence the amount of stretch. A CMM permits accurate calculating of this depth correction. The following method is used to estimate the stretch for real-time depth correction:

1. A CMM (e.g. the known CTES Orpheus model with a suitable computer) is used to calculate the WL stretch versus depth for a range of depths and production flow rates. A table of data points for stretch values are calculated as shown in FIG. 3.
2. The data points calculated with the CMM are stored in a look-up data table in the computer's computer memory.
3. At any given moment during the logging run, an estimate of current WL stretch may be taken from the table based on the current depth and flow rate.
4. Interpolation or extrapolation (with the SMM) is used to calculate the predicted stretch in real-time for the depth and current flow rate do not coincide with the values used to create the data table.
5. At regular set time intervals or when needed, the CMM is re-run and the data table is updated to include additional data points.

FIG. 4 shows an example of one real-time modeling system 10 according to the present invention. The system includes one or more (typically a plurality) of data acquisition devices 12, including sensors 13 for sensing measured parameters such as pump pressure, measured depth, mud pit volume and other such well-known parameters. The devices 12 intercommunicate with one or more modeling computers 14 via suitable line, wireless, and/or network connections 16. The modeling computer(s) 14 are programmed to run the CMM as required to then develop the related SMM. The modeling computer(s) 14 may then display in real-time results for a well operator and/or real-time display device(s) or computer(s) 18 interconnected with and intercommunicating with the computers 14 may do this. The real-time computer or computers and the modeling computer(s) may be separate computer(s) connected by some type of communication means such as a line or network 16, as shown, or they may in practice be the same computer or computers.

1. The data acquisition device or devices 12 acquires channels of measured data from the sensors 13 and makes these data channels available to the other computers through the line or network 16.
2. At regular time intervals or when required, the modeling computer or computers 14 run the CMM for a plurality of points using whatever measured data is needed.
3. The modeling computer 14 then calculates curve-fit variables (A, B, etc.) or places the calculated parameters in a data table.
4. The curve-fit variables (A, B, etc.) or the data table are then passed via the line or network 16 to the real-time display computer(s) 18.
5. The real-time display computer or computers 18 use the SMM equation and curve-fit variables or the data table to display the calculated parameters in real-time, along with the measured data from the data channels.

The present invention, therefore, provides in certain, but not necessarily all embodiments, a method for drilling a wellbore in the earth, the method including introducing a bit of a drilling system into the earth to drill a wellbore, the bit connected to a drill string that extends down from earth surface to the bit, rotating the bit to drill the wellbore, while rotating the bit predicting a force on the bit by calculating the force in real-time, said calculating done by first obtaining a series of known data points related to said force using a conveyance method model technique, developing an equation of a curve based on the series of known data points, and using at least one point on the curve not corresponding to the known data points to predict force on the bit for said at least one point on the curve; such a method may include one or some of the following, in any possible combination: wherein the force on the bit is the weight on the bit and/or the torque on the bit; wherein the conveyance model method technique produces real-time data; wherein the conveyance model method technique does not produce real-time data; wherein the conveyance model method technique calculates the known series of data points prior to the rotation of the bit for drilling; wherein the conveyance model method technique calculates the known series of and/or additional data points during drilling of the wellbore; wherein the conveyance model method technique calculates the known series of and/or additional data points at multiple times during drilling of the wellbore; wherein said calculation is done between every five to fifteen minutes during drilling; wherein the at least one point on the curve is a plurality of points on the curve; wherein the equation is developed using a curve-fit technique; wherein error between the predicted force and the actual force is minimized by developing a plurality of equations of curves based on the series of known data points and calculating an error for each curve fit of said equations of curves and then selecting the equation with the least error; wherein the drill bit is run into the wellbore as it drills down in the earth, the method further including wherein developing the equation of a curve that passes through the series of known points includes determining in real time a first equation for running the bit into the wellbore taking into account stretching of the drill string, and predicting force on the bit as it is run into the wellbore using the first equation; wherein as the wellbore is drilled additional actual data is obtained and the conveyance method model technique is used to obtain additional known data points based on the additional actual data which are then used to further develop. the equation to further predict the force on the bit; wherein the conveyance method model technique is performed on a first computer and the equation is developed on a second computer in communication with the first computer; wherein developing an equation of a curve that passes through the series of known data points includes developing a plurality of equations, each equation related to a different value of a wellbore drilling parameter, and choosing an equation of the plurality of equations to predict force on the bit based on the value of the wellbore parameter; wherein the wellbore drilling parameter is drilling fluid density of drilling fluid used in the drilling of the wellbore; wherein a predicted force on bit is displayed on a display screen; wherein a simple mathematical model technique is used to determine the equation, the simple mathematical model taking into account a plurality of drilling parameters; wherein a drilling parameter not taken into account by the simple mathematical model changes significantly and the conveyance method model technique does take said drilling parameter into account to produce new actual data points, the simple mathematical model technique then taking into account the new actual data points to predict the force on the bit; wherein at a regular time interval (and, in one aspect, during drilling) new actual data points determined by the conveyance method model technique are taken into account by the simple mathematical model technique; and/or wherein the drill string is coiled tubing, the bit is rotated by a downhole motor, and the force is weight on bit.

The present invention, therefore, provides in certain, but not necessarily all embodiments, a method for taking into account the effects of complex conveyance method model technique (CMMT) results in real-time in a wellbore operation, the method including calculating with a CMMT a series of data points based on wellbore data, modeling the relationship between the series of data points and the actual wellbore data using a simple mathematical model technique (SMMT) to develop a simple model for predicting a wellbore operations parameter, and using the simple model to predict a wellbore operations parameter; wherein the wellbore operation is drilling using a bit on a drill string and/or the wellbore operations parameter is from the group consisting of weight on bit, torque on bit and change in a drill string length; wherein the wellbore data is actual wellbore data; and/or wherein the wellbore data is predicted wellbore data.

The present invention, therefore, provides in certain, but not necessarily all embodiments, a method for performing an operation in a wellbore in the earth, the method including introducing a tool into the earth to perform an operation, the tool connected to a conveyance system for conveying the tool in the wellbore, determining a series of first data points for a set of parameters for the operation using a conveyance method model technique, developing an equation to fit the series of first data points using a simple mathematical model technique, and in real-time using the equation to predict a value for at least one second data point not coincident with any of the first data points for a parameter of the set of parameters for the operation; such a method may include one or some of the following, in any possible combination: wherein the at least one second data point is a plurality of second data points; wherein the conveyance system is from the group of conveyance systems consisting of coiled tubing system, wireline system, and drill pipe system; and/or wherein the tool is a drill bit and/or the parameter to be predicted is from the group consisting of weight on bit, torque on bit, and stretch of the conveyance system.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A method for drilling a wellbore in the earth, the method comprising introducing a bit of a drilling system into the earth to drill a wellbore, the bit connected to a drill string that extends down from earth surface to the bit, rotating the bit to drill the wellbore, while rotating the bit predicting a force on the bit by calculating the force in real-time, said calculating done by first obtaining a series of known data points related to said force using a conveyance method model technique, developing an equation of a curve based on the series of known data points, and using at least one point on the curve not corresponding to the known data points to predict force on the bit for said at least one point on the curve.

2. The method of claim 1 wherein the force on the bit is the weight on the bit.

3. The method of claim 1 wherein the force on the bit is the torque on the bit.

4. The method of claim 1 wherein the conveyance model method technique produces real-time data.

5. The method of claim 1 wherein the conveyance model method technique does not produce real-time data.

6. The method of claim 1 wherein the conveyance model method technique calculates the known series of data points prior to the rotation of the bit for drilling.

7. The method of claim 1 wherein the conveyance model method technique calculates the known series of data points during drilling of the wellbore.

8. The method of claim 1 wherein the conveyance model method technique calculates the known series of data points at multiple times during drilling of the wellbore.

9. The method of claim 1 wherein said calculation is done between every five to fifteen minutes during drilling.

10. The method of claim 1 wherein the at least one point on the curve is a plurality of points on the curve.

11. The method of claim 1 wherein the equation is developed using a curve-fit technique.

12. The method of claim 1 wherein error between the predicted force and the actual force is minimized by developing a plurality of equations of curves based on the series of known data points and calculating an error for each curve fit of said equations of curves and then selecting the equation with the least error.

13. The method of claim 1 wherein the drill bit is run into the wellbore as it drills down in the earth, the method further comprising wherein developing the equation of a curve that passes through the series of known points includes determining in real time a first equation for running the bit into the wellbore taking into account stretching of the drill string, and predicting force on the bit as it is run into the wellbore using the first equation.

14. The method of claim 1 wherein as the wellbore is drilled additional actual data is obtained and the conveyance method model technique is used to obtain additional known data points based on the additional actual data which are then used to further develop the equation to further predict the force on the bit.

15. The method of claim 14 wherein the conveyance method model technique is performed on a first computer and the equation is developed on a second computer in communication with the first computer.

16. The method of claim 1 wherein developing an equation of a curve that passes through the series of known data points includes developing a plurality of equations, each equation related to a different value of a wellbore drilling parameter, and choosing an equation of the plurality of equations to predict force on the bit based on the value of the wellbore parameter.

17. The method of claim 16 wherein the wellbore drilling parameter is drilling fluid density of drilling fluid used in the drilling of the wellbore.

18. The method of claim 1 wherein a predicted force on bit is displayed on a display screen.

19. The method of claim 1 wherein a simple mathematical model technique is used to determine the equation, the simple mathematical model taking into account a plurality of drilling parameters.

20. The method of claim 19 wherein a drilling parameter not taken into account by the simple mathematical model changes significantly and the conveyance method model technique does take said drilling parameter into account to produce new actual data points, the simple mathematical model technique then taking into account the new actual data points to predict the force on the bit.

21. The method of claim 19 wherein at a regular time interval new actual data points determined by the conveyance method model technique are taken into account by the simple mathematical model technique.

22. The method of claim 1 wherein the drill string is coiled tubing, the bit is rotated by a downhole motor, and the force is weight on bit.

23. A method for taking into account the effects of complex conveyance method model technique (CMMT) results in real-time in a wellbore operation, the method comprising calculating with a CMMT a series of data points based on wellbore data, modeling the relationship between the series of data points and the actual wellbore data using a simple mathematical model technique (SMMT) to develop a simple model for predicting a wellbore operations parameter, and using the simple model to predict a wellbore operations parameter.

24. The method of claim 23 wherein the wellbore operation is drilling using a bit on a drill string and the wellbore operations parameter is from the group consisting of weight on bit, torque on bit and change in a drill string length.

25. The method of claim 23 wherein the wellbore data is actual wellbore data.

26. The method of claim 23 wherein the wellbore data is predicted wellbore data.

27. A method for performing an operation in a wellbore in the earth, the method comprising introducing a tool into the earth to perform an operation, the tool connected to a conveyance system for conveying the tool in the wellbore, determining a series of first data points for a set of parameters for the operation using a conveyance method model technique, developing an equation to fit the series of first data points using a simple mathematical model technique, in real-time using the equation to predict a value for at least one second data point not coincident with any of the first data points for a parameter of the set of parameters for the operation.

28. The method of claim 27 wherein the at least one second data point is a plurality of second data points.

29. The method of claim 27 wherein the conveyance system is from the group of conveyance systems consisting of coiled tubing system, wireline system, and drill pipe system.

30. The method of claim 27 wherein the tool is a drill bit and the parameter to be predicted is from the group consisting of weight on bit, torque on bit, and stretch of the conveyance system.

* * * * *